US007152919B2

(12) United States Patent
Wurzelbacher et al.

(10) Patent No.: US 7,152,919 B2
(45) Date of Patent: Dec. 26, 2006

(54) WEARABLE KNEEL-SIT SUPPORT DEVICE

(75) Inventors: Steven J. Wurzelbacher, Cincinnati, OH (US); Ova E. Johnston, Franklin, OH (US); Stephen D. Hudock, Cincinnati, OH (US)

(73) Assignee: The United States of America as represented by the Department of Health and Human Services, Centers for Disease Control and Prevention, Washington, DC (US)

( * ) Notice: Subject to any disclaimer, the term of this patent is extended or adjusted under 35 U.S.C. 154(b) by 377 days.

(21) Appl. No.: 10/481,532

(22) PCT Filed: May 28, 2002

(86) PCT No.: PCT/US02/16790

§ 371 (c)(1),
(2), (4) Date: Dec. 19, 2003

(87) PCT Pub. No.: WO03/000093

PCT Pub. Date: Jan. 3, 2003

(65) Prior Publication Data

US 2004/0232739 A1 Nov. 25, 2004

Related U.S. Application Data

(60) Provisional application No. 60/300,315, filed on Jun. 22, 2001.

(51) Int. Cl.
*A47C 1/00* (2006.01)
*A47C 7/50* (2006.01)

(52) U.S. Cl. ..... 297/4; 297/423.11

(58) Field of Classification Search ..... 297/4, 297/423.11; 2/22, 24
See application file for complete search history.

(56) References Cited

U.S. PATENT DOCUMENTS 2,432,565 A 12/1947 Ferguson (Continued)

FOREIGN PATENT DOCUMENTS

EP 0 836 821 A 4/1998

(Continued)

OTHER PUBLICATIONS

Balans Produkter AB website, "The Alternative for All Kneeling Work" (2 pages).

(Continued)

*Primary Examiner*—Milton Nelson, Jr.
(74) *Attorney, Agent, or Firm*—Klarquist Sparkman, LLP

(57) ABSTRACT

A wearable kneel-sit support device includes a U-shaped body that is pivotally connected to both a seat member and a base member. A linking member connects the seat member and the base member, such that moving one of the seat member and the base member causes both the seat member and the base member to rotate from a folded position adjacent the leg of the user to an unfolded position. In the unfolded position, the base member can rest on a horizontal surface and the seat member is substantially parallel to the base member, so that the wearer can sit on the seat while kneeling. The device may be worn on the lower leg of a user in a folded position to allow unhindered ambulation.

24 Claims, 8 Drawing Sheets

U.S. PATENT DOCUMENTS

| | | | |
|---|---|---|---|
| 2,631,652 | A | 3/1953 | Bannister |
| 3,025,526 | A | 3/1962 | Ramon |
| 3,863,978 | A | 2/1975 | Gillings, Jr. |
| 4,377,309 | A | 3/1983 | Mengshoel |
| 4,589,699 | A | 5/1986 | Dungan |
| 4,772,071 | A | 9/1988 | Richards |
| 5,073,986 | A | 12/1991 | Farrago |
| 5,125,479 | A | 6/1992 | Nemes et al. |
| 5,380,021 | A | 1/1995 | Doherty |
| 5,577,800 | A | 11/1996 | Earl, Jr. |
| 5,865,507 | A | 2/1999 | Earl, Jr. |
| 6,089,667 | A | 7/2000 | Hobbs |

FOREIGN PATENT DOCUMENTS

| | | |
|---|---|---|
| GB | 2098060 | 11/1982 |

OTHER PUBLICATIONS

Orthobionics website "Knee Saver" (1 page).

Racatac Products, Inc. website, "Protect Your Knees, Help Your Back, Work Fast and Easty with the RACATAC™" (4 pages).

WEARABLE KNEEL-SIT SUPPORT DEVICE

CROSS-REFERENCE TO RELATED APPLICATIONS

This is the National Stage of International Application No. PCT/US02/16790, filed May 28, 2002, which claims the benefit of U.S. Provisional Patent Application No. 60/300,315, filed Jun. 22, 2001.

FIELD OF INVENTION

This invention relates to devices that relieve pressure on a kneeling person, and more particularly to such devices that include a seat that supports a portion of the worker's weight while he is kneeling.

BACKGROUND

There are many occupations such as shipbuilding, mining, plumbing, carpet and floor installation, construction, repair, services, and auto body repair in which people must spend a considerable amount of time kneeling or squatting. Such people put 70% of their body weight on a few cubic centimeters of the tibia and patella while kneeling as opposed to putting 22% of their body weight on each knee while walking. Prolonged kneeling increases a person's risk of developing musculoskeletal knee disorders such as osteoarthrosis, meniscal lesions, chondromalacia, and bursitis. Also, it is uncomfortable to maintain a kneeling position for a long period, which can decrease productivity of workers.

Various studies have been made on injury to the knee from prolonged kneeling or squatting. Elsner et al., [Knee Joint Arthroses and Work-Related Factors] *Soz Praventivmed,* 1996; 41(2):98–106, found that men who worked on their knees had a significantly greater chance of developing arthrosis of the knee. Cooper et al., Occupational Activity and Osteoarthritis of the Knee, *Ann Rheum Dis* 1994 February; 53(2):90–3, found that men whose job entailed more than 30 minutes per day of squatting or kneeling had a significantly greater chance of developing osteoarthritis.

Kivimaki et al., Knee Disorders in Carpet and Floor Layers' and Painters, *Scand J Work Environ Health* 1992 October; 18(5):310–6, and Occupationally Related Ultrasonic Findings in Carpet and Floor Layers' Knees, *Scand J Work Eviron Health* 1992 December; 18(6):220–2, found that osteophytes of the patella were more common among carpet and floor layers than among painters, and that self-reported knee bursitis was also more prevalent in carpet and floor layers. Furthermore, ultrasonography of the knee showed thickening of the prepatellar or superficial infrapatellar bursa in 49% of the carpet and floor layers and 7% of the house painters. This ultrasonographic finding was associated with knee pain in kneeling postures.

Thun et al., Morbidity from Repetitive Knee Trauma in Carpet and Floor Layers, *Br J Ind Med* 1987 September; 44(9):611–20, found that self reported bursitis and arthritis of the knee were more common in terazzo workers who kneel than in other groups who seldom kneel. Coggon et al., Occupational Physical Activities and Osteoarthritis of the Knee, *Arthritis Rheum* 2000 July; 43(7):1443–9, found that the risk of developing knee osteoarthritis is higher for people who kneel or squat for prolonged periods of time. Sandmark et al., Primary Osteoarthrosis of the Knee in Men and Women as a Result of Lifelong Physical Load from Work, *Scand J Work Environ Health* 2000 February; 26(1):20–5, found that among men there is an association between kneeling and knee osteoarthrosis.

Kasch and Enderlein, [Damage to the Knee Joint in Ship Building] *Beitr Orthop Traumatol* 1986 October; 33(10):487–94, reported that x-rays showed that there was an increased occurrence of knee injuries in welders as compared to other groups.

A study of ergonomics and shipbuilding by the National Institute for Occupational Safety and Health (NIOSH) found that kneeling or squatting for long periods of time may be related to the finding that the incidence of lower extremity musculoskeletal injury in domestic shipbuilding and ship repair industries is 300–220 percent higher than in the overall manufacturing sector. NIOSH also found that knee injuries have the highest cost compared to other injuries per employee per year.

The health risks and costs associated with prolonged kneeling and squatting have led to efforts to prevent such injuries. Such efforts have recognized the need to reduce the amount of flexion in the knee and the amount of contact stress applied to the facet of the knee joint. Efforts to reduce such stress would also reduce forces on the internal knee and lower back that are known risk factors for musculoskeletal knee disorders. Unfortunately, many of the devices that have been used in the past to relieve pressure on the knees are bulky, heavy, and of questionable durability.

U.S. Pat. No. 3,025,526 discloses a kneeling device that attaches to a user's leg. It includes a kneepad that is attached to the user's knee by straps that are positioned below the knee and in the ankle region. When a user is in the standing position, the device unfolds and rests partially on the thigh. This device is bulky and restricts a user's movements while walking. Also, it is essentially a kneepad and does not take the weight off the user's knee.

U.S. Pat. No. 4,772,071 discloses a kneeling device that inlcudes a kneepad attached to a seat. The device is attached to the lower leg. The device is, however, bulky and must be removed when the user wants to stand or walk because it hampers movement.

In U.S. Pat. No. 5,865,507, a rectangular base has a seat and a pair of coextensive troughs with knee-wells located at the ends of the troughs. A user sits in the seat and places his legs in the troughs and his knees in the knee-wells. The device is also bulky and can only be used on unobstructed horizontal surfaces. Furthermore, it is not easily moveable, and every time a user wants to change his position, he must stand up and lift the device to move it. The device is heavy and can cause tripping because of its bulkiness.

U.S. Pat. No. 6,089,667 describes a motorized knee support device comprising a rigid plate that is covered with a pad. The plate is mounted on a base by a threaded post, and the height of the plate can be adjusted by a gear system. The device is relatively difficult to mount because it requires a person to stand in front of the unit, squat or kneel down, and then extend the leg back underneath the support. It is also not portable, but rather is freestanding, heavy, and bulky.

U.S. Pat. No. 5,577,800 discloses a work seat that is used while in a kneeling position. The device has a base with wheels, an adjustable seat, and a handle. The device allows the user, while kneeling, to support body weight primarily on the device rather than on the knees. The device, however, is bulky, heavy, and can only be used on unobstructed surfaces, thus there are many places where it cannot be used. Also, the wheels only move forward and backward. Thus the user must dismount when the device needs to be moved laterally.

In U.S. Pat. No. 5,380,021, a mobile knee support includes a pair of slings supported by a pair of casters. The slings support the knees of the user, and the casters allow for mobility. Since the user's weight is distributed on the knees, the device does not reduce forces on the internal knee and lower back. Also, the device does not reduce flexion in the knee joint. Since there are wheels, it can only be used on a relatively level, smooth, and unobstructed surface.

A sit-kneel chair is shown in U.S. Pat. No. 4,589,699. The chair has a seat portion and a knee support which are designed primarily to relieve tension of the lower back. Since the user sits in an upright position, the device is not suitable for use when kneeling close to the ground.

U.S. Pat. No. 4,377,309 discloses another support device having a seat attached to a base, for supporting the user in a sitting-kneeling position.

Balans Produkter AB produces a device under the trademark Balans Snap Sit, which includes a knee-well attached to a seat. The device does not fold while attached to the leg, and it is bulky and restricts movement while walking. It is also flammable, not sufficiently durable for regular use by workers in heavy industry, and has knee-wells that can gather materials, such as weld slag.

There is thus a need for a device that relieves pressure from the knees while kneeling, is easily portable, is attachable to the body, and can be moved automatically by the user without the user having to pick up the device and manually move it to a new position. There is also independently a need for a device that that is nonflammable and durable, so that it can be used in heavy industry and can be used on horizontally constrained and uneven surfaces. It would also be helpful to provide such a device that is comfortable to use while kneeling.

SUMMARY

A wearable knee support device for relieving pressure on a user's knee is disclosed. The device includes a body adapted to receive the leg of a user. A seat member is pivotally connected to the body and adapted to receive the weight of the user. A base member is also pivotally connected to the body and adapted to support the device in an unfolded position. At least one linking member connects the seat member and the base member. Moving either the seat member or the base member causes the linking member to rotate both the seat member and the base member from a folded position adjacent the leg of the user to an unfolded position. The base member can then rest on a horizontal surface and the seat member can support the user's weight.

In some embodiments, this kneeling device reduces the amount of flexion in the knee joint and the amount of contact stress applied to the facet of the knee joint, to reduce forces on the internal knee and lower back.

DETAILED DESCRIPTION

Figure 1:
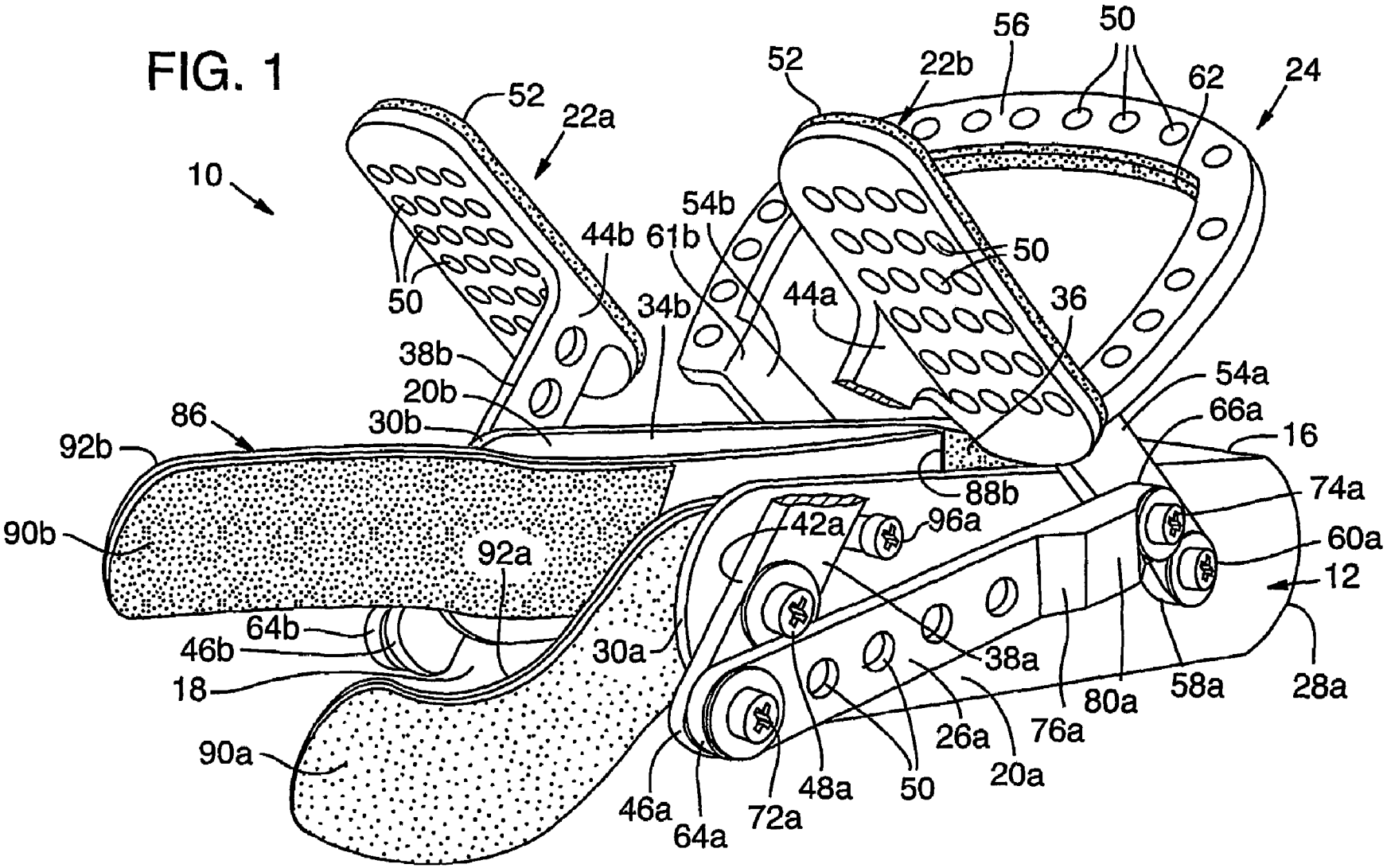
FIG. 1 is a perspective view of a wearable kneel-sit support device according to one embodiment shown in the folded position with part of the leg of the seat member cut away for a better view of the body of the device.
Figure 7:
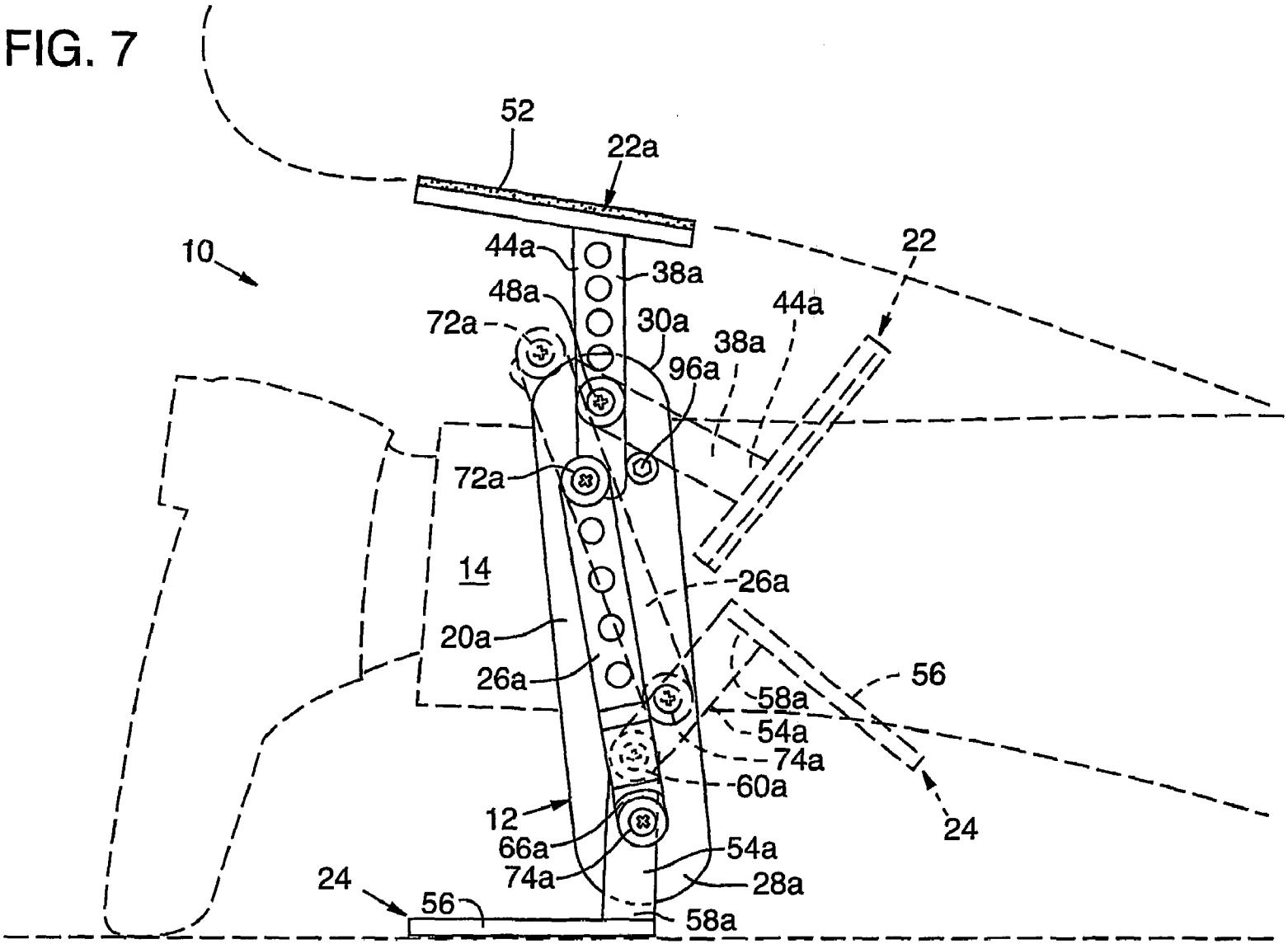
FIG. 7 is a schematic side view of the device in the unfolded position shown attached to the lower leg of a user when the user is in a kneeling position, with the device in the folded position shown in dashed lines.

Referring to the drawings, the wearable kneel-sit support device 10 includes a U-shaped body 12 adapted to receive the leg 14 of a user. As illustrated in FIG. 1, body 12 has a closed end 16 and an open end 18 joined by a pair of side members 20*a*, 20*b*. In the particularly disclosed embodiment, a seat includes two separate seat members 22*a*, 22*b* each of which is pivotally attached to the body 12 adjacent the body's open end 18. The seat is adapted to provide a support surface on which the user can sit when the device is in the unfolded position, as shown particularly in FIGS. 3 and 7. Although the seat is illustrated as having two distinct support members 22*a*, 22*b* that are spaced to support each buttock, the seat can also be a single member that is wide enough to provide a seat surface.

Figure 2:
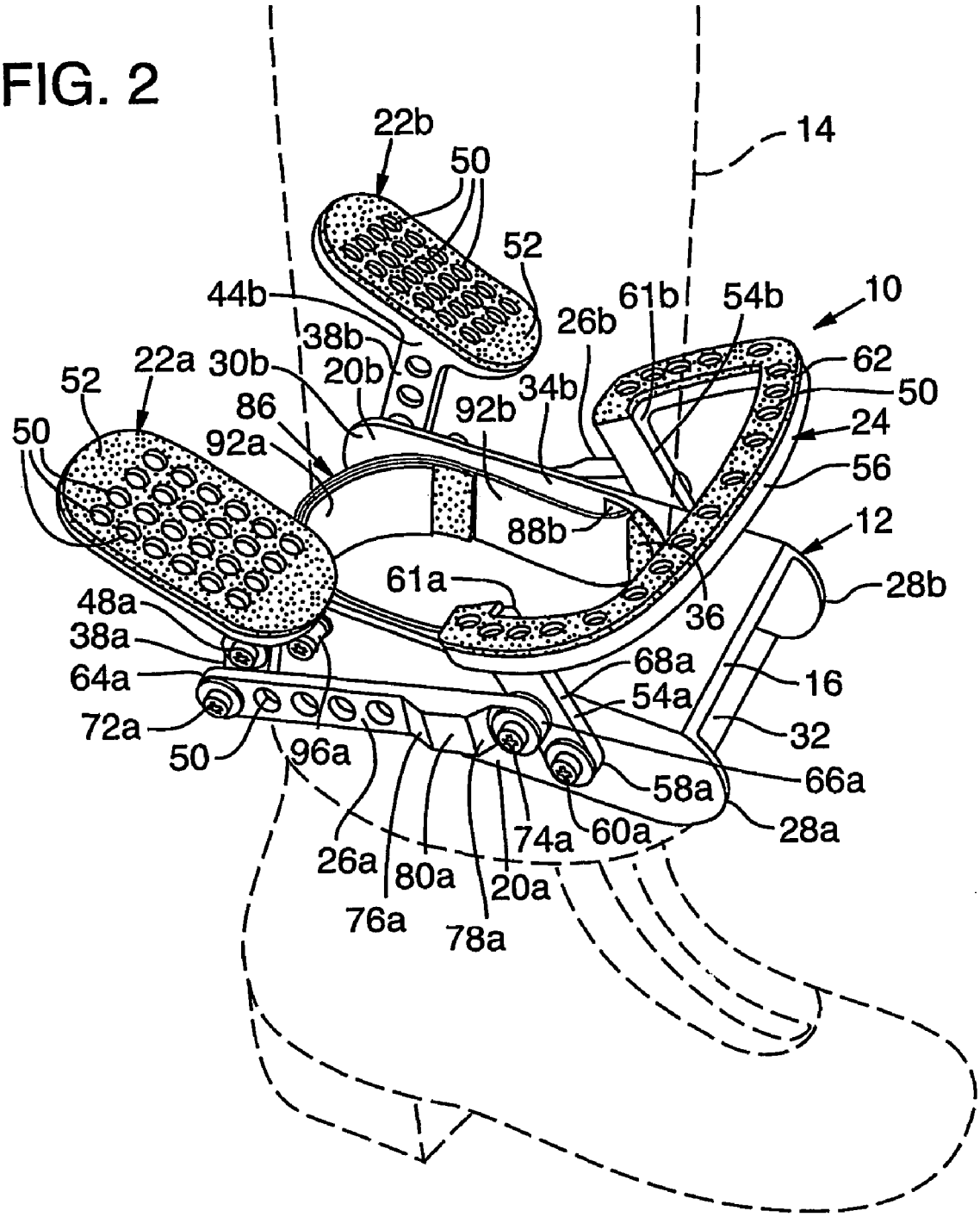
FIG. 2 is a view of the device of FIG. 1 in the folded position attached to the lower leg of a user.
Figure 3:
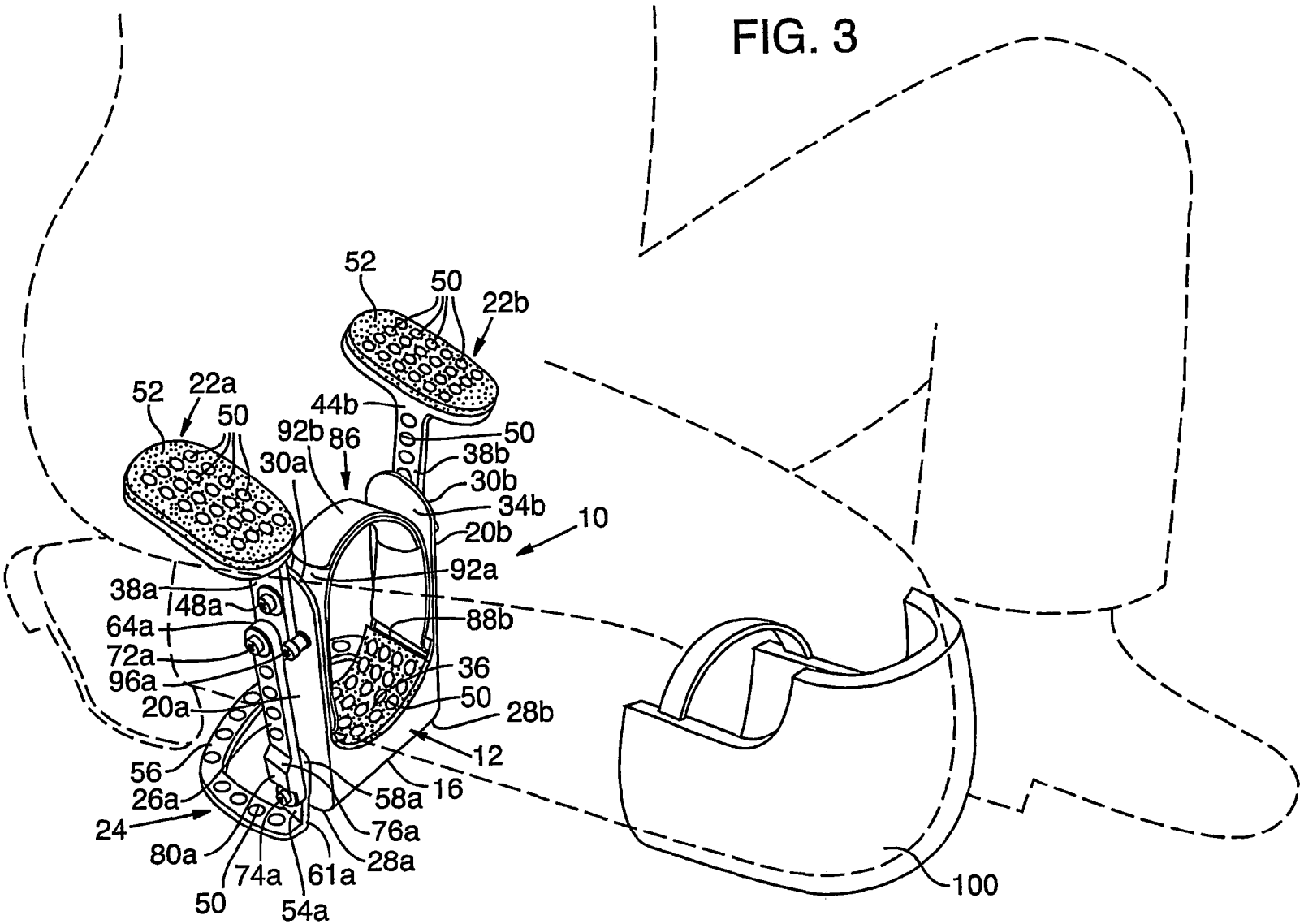
FIG. 3 is a view of the device in the unfolded position when the user is kneeling and placing his weight on the seat member.
Figure 6:
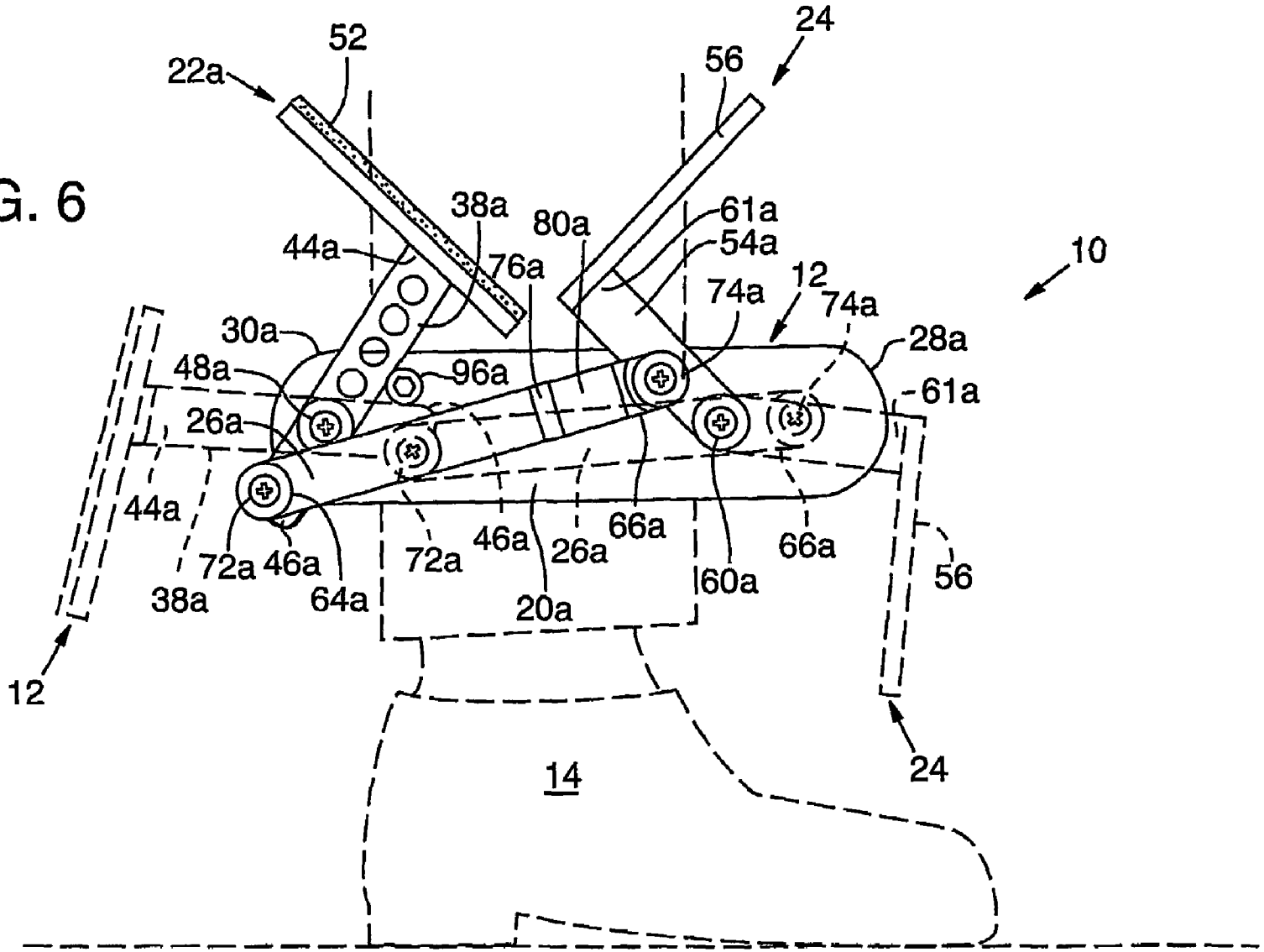
FIG. 6 is a schematic side view of the device in the folded position attached to the lower leg of a user, with the positioning of the device in the unfolded position shown in dashed lines.

As shown particularly in FIG. 3, base member 24 is pivotally attached to the body 12 adjacent the closed end 16 to support the device and the user when the device is in the unfolded position. Linking members 26*a*, 26*b* (FIGS. 2 and 3) link the seat members 22*a*, 22*b* to the base member 24, whereby movement of either the seat members 22*a*, 22*b* or the base member 24 rotates both the base and the seat from the folded position of FIGS. 1, 2, and 6, to the unfolded position.

Figure 4:
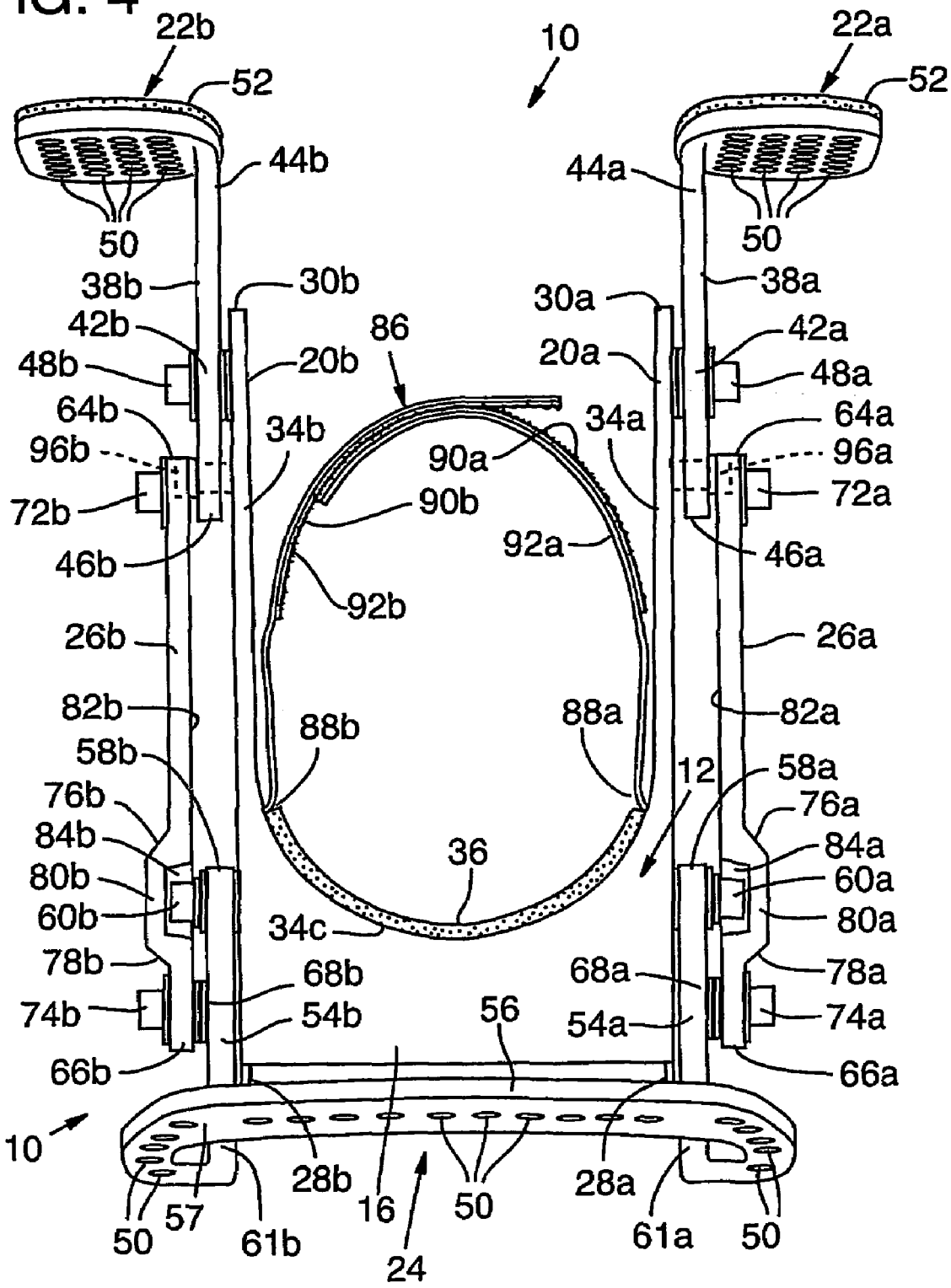
FIG. 4 is a front view of the device in the unfolded position.

The U-shaped body 12 includes the pair of parallel side members 20*a* and 20*b*, which have rounded ends 28*a*, 28*b*, 30*a*, and 30*b* (FIGS. 1 and 2) that avoid sharp corners. As shown particularly in FIG. 2, the ends 28*a* and 28*b* extend beyond the closed end 16 to provide a hollow recessed space 32. The parallel sides 20*a* and 20*b* and the closed end 16 define the U-shaped body 12, which for example is made of aluminum or plastic. As shown in FIG. 4, the body 12 has an inside surface 34*a*, 34*b* and 34*c*. In the illustrated embodiment, padding 36 (FIGS. 3 and 4) is desirably added to the inside surface 34*c* to enhance comfort when the device is secured to the leg. The padding 36 may, for example, be flame retardant (such as viscoelastic dip or leather covered foam). The U-shaped body 12 supports the seat member 22 and the base member 24, and connects the device 10 to the lower leg 14 of the user.

The seat members 22*a*, 22*b* are respectively attached to a first pair of legs 38*a* and 38*b* (FIGS. 3 and 4). The legs 38*a* and 38*b* are pivotally attached to the U-shaped body 12 adjacent the open end 18. The first leg 38*a* is pivotally connected to the first side 20*a* of the U-shaped body 12 at a position 42*a* that is intermediate its distal and proximal ends 44*a* and 46*a*. Leg 38*a* is connected by means of a securing member 48*a* that is held in place by a nut (not shown) attached to its back. In the illustrated example, the securing members are shoulder bolts secured with washers and nuts. Similarly, the second leg 38*b* is pivotally attached to the second side 20*b* of the U-shaped body 12 at a position 42*b* that is intermediate its distal and proximal ends 44*b* and 46*b*. Leg 38*b* is connected by means of a securing member 48*b*.

The first and the second legs 38*a* and 38*b* support, at their distal ends 44*a* and 44*b*, the first and second seats members 22*a* and 22*b*. The legs 38*a* and 38*b* can be welded to the seats 22*a* and 22*b*, or they can be formed as a single piece. The first and second seat members 22*a* and 22*b* are shown as being generally oval shaped in the illustrated example. Holes 50 are made in the seats members 22*a* and 22*b* and the pair of legs 38*a* and 38*b* in order to lighten the device 10. The seat member 22 can be made from aluminum or reinforced plastic. The first and second seats 22*a* and 22*b* are padded at 52 to increase the comfort of the user when he places his weight on them.

The base member 24 is comprised of a second pair of legs 54*a* and 54*b* attached to a generally horseshoe shaped base 56. See FIGS. 1 and 4. The legs 54*a* and 54*b* can be welded to the base 56, or they can be formed as a single piece. The base member 24 is pivotally attached to the U-shaped body 12 adjacent the closed end 16. The first leg 54*a* is pivotally attached at its proximal end 58*a* to the first side 20*a* of the U-shaped body 12. Leg 54*a* is connected by means of a securing member 60*a*. As shown in FIG. 4, the second leg 54*b* is pivotally attached at its proximal end 58*b* to the second side 20*b* of the U-shaped body 12. Leg 54*b* is connected by means of a securing member 60*b*.

The first and the second legs 54*a* and 54*b* are attached at their distal ends 61*a* and 61*b*, respectively, to the base 56. See FIG. 4. The base 56 has an underside 57 that rests on a surface when the device 10 is in the unfolded position. Holes 50 are made in the base 56 in order to lighten the device 10. The pair of legs 54*a* and 54*b* and the base 56 are comprised of aluminum or reinforced plastic. The base 56 is padded at 62 in order to add comfort. See FIGS. 1 and 2.

First and second linking members 26*a* and 26*b* link the pair of legs 38*a* and 38*b* of the seat member 22 to the pair of legs 54*a* and 54*b* of the base member 24. See FIG. 1. The first linking member 26*a* is attached at a first end 64*a* to the proximal end 46*a* of the first leg 38*a* of the seat member 22. The first linking member 26*a* is attached at a second end 66*a* to the first leg 54*a* of the base member 24 at a position 68*a* intermediate its distal end 61*a* and proximal end 58*a*. See FIGS. 4 and 5. Securing members 72*a* and 74*a* connect the first linking member 26*a* to the first leg 38*a* of the seat member 22 and the first leg 54*a* of the base member 24. The first linking member 26*a* is formed as a flat bar with a raised segment having upward slopes 76*a* and 78*a* that form a ridge 80*a* near the second end 66*a*. Referring to FIG. 4, the side 82*a* of the first linking member 26*a* directly opposite the ridge 80*a* forms a hollow recess 84*a*.

Figure 5:
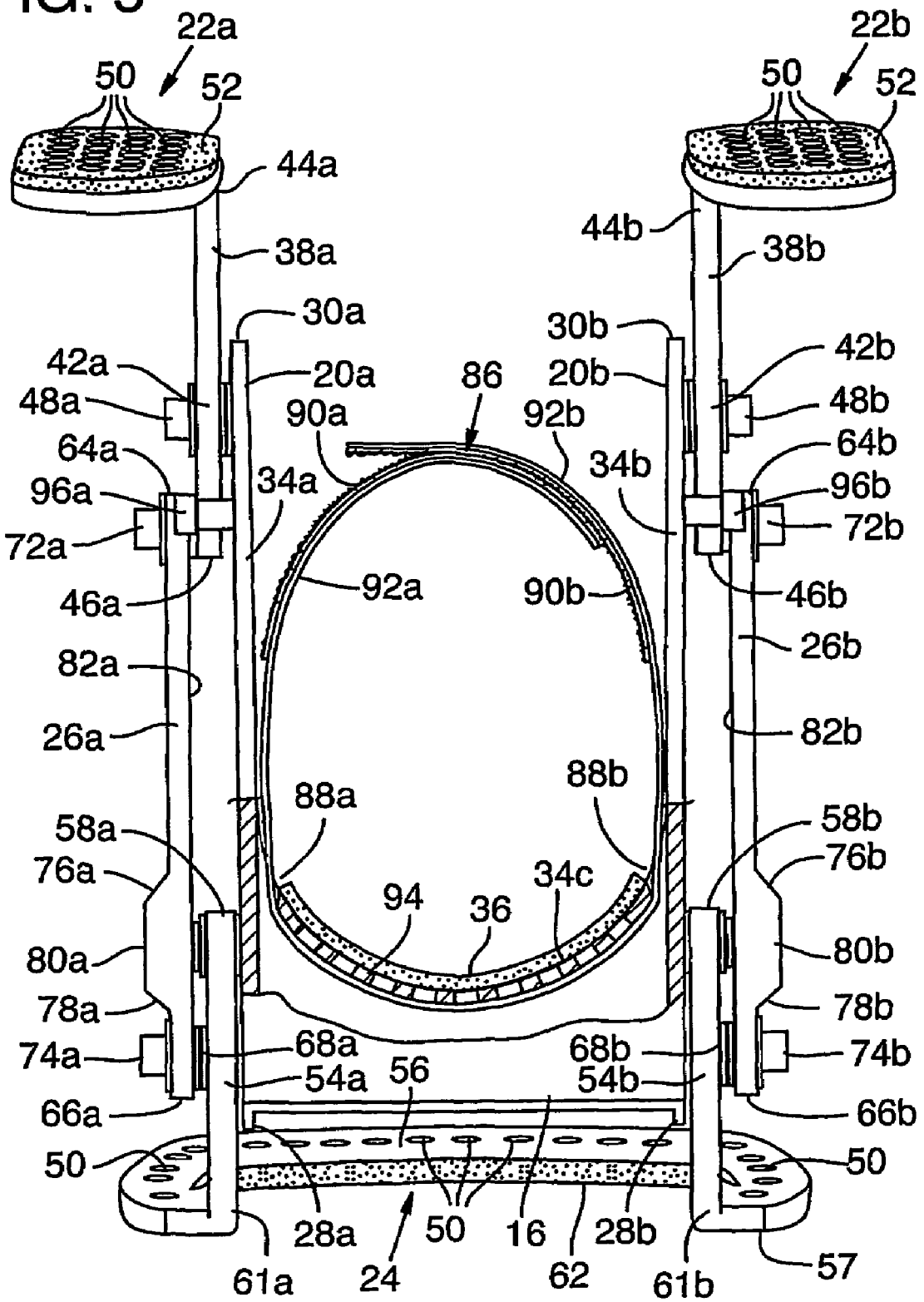
FIG. 5 is a back view of the device in the unfolded position with part of the body cut away to show the positioning of the attachment member within the body.

Similarly, the second linking member 26*b* is attached at a first end 64*b* to the proximal end 46*b* of the second leg 38*b* of the seat member 22. The second linking member 26*b* is attached at a second end 66*b* to the second leg 54*b* of the base member 24 at a position 68*b* intermediate its distal and proximal ends 61*b* and 58*b*, as shown in FIGS. 4 and 5. The second linking member 26*b* is formed as a flat bar with a raised segment having upward slopes 76*b* and 78*b* that form a ridge 80*b* near the second end 66*b*. The side 82*b* of the second linking member 26*b* directly opposite the ridge 80*b* forms a hollow recess 84*b*. Securing members 72*b* and 74*b* connect the second linking member 26*b* to the second leg 38*b* of the seat member 22 and the second leg 54*b* of the base member 24. The linking members 26*a* and 26*b* connect the legs 38*a* and 38*b* of the seat member 22 to the legs 54*a* and 54*b* of the base member 24, so that pivoting of either the seat member 22 or the base member 24 causes them both to pivot.

Referring to FIG. 2, an attachment member 86 is used to attach the device 10 to the leg 14 of a user. As shown in the embodiment illustrated in FIG. 5, the attachment member 86 passes through an opening 88*a* in the inside surface 34*a* of the first side 20*a* of the body 12, into the hollow recessed space 32, seats on a front surface 94 of the recessed space 32, and exits from an opening 88*b* in the inside surface 34*b* of the second side 20*b* of the body 12. The attachment member 86 is shown in the illustrated embodiment as being a strap having Velcro® portions 90*a* and 90*b* at ends 92*a* and 92*b*. The ends 92*a* and 92*b* of the attachment member 86 can be opened and closed when the user wants to insert or remove his lower leg 14.

The device 10 is shown in the unfolded position in FIGS. 3–5. To move from the folded position of FIG. 2 to the unfolded position of FIG. 3, the seat members 22*a*, 22*b* and the base member 24 are pivoted away from each other until the U-shaped body 12, the first pair of legs 38*a* and 38*b*, and the second pair of legs 54*a* and 54*b* are in a generally parallel configuration. The first and second seats 22*a* and 22*b*, and the base 56 are generally perpendicular to the U-shaped body 12. In this configuration, as shown in FIG. 4, the securing members 60*a* and 60*b* that connect the second pair of legs 54*a* and 54*b* to the U-shaped body 12 fit within recesses 84*a* and 84*b* to prevent interference with the movement of the linking members 26*a* and 26*b*.

Referring to FIG. 5, a first position stop 96*a* is attached to first side 20*a* of the U-shaped body 12, and a second position stop 96*b* is attached to the second side 20*b* of the U-shaped body 12. When the device 10 is in the unfolded position, the proximal ends 46*a* and 46*b* of the first pair of legs 38*a* and 38*b* of the seat member 22 abut the position stops 96*a* and 96*b*. The position stops 96*a* and 96*b* determine the pivoting limit of the first pair of legs 38*a* and 38*b* of the device 10 to achieve the unfolded position. In addition, the inside surfaces of the hollow recesses 84*a* and 84*b* (FIG. 4) contact the securing members 60*a* and 60*b*, thus also acting as a stop to prevent further motion of the U-shaped body 12.

In use, as shown in FIGS. 1 and 2, the seat member 22 and the base member 24 are pivoted upward so that the device 10 is in the folded position. The seats 22*a* and 22*b*, and the base 56 are folded over the U-shaped body. The device 10 is positioned so that the closed end 16 is in front. The user opens the attachment member 86 by unfastening the Velcro® straps 90*a* and 90*b*, and places the lower leg 14 through the open end 18 of the U-shaped body 12, until the device abuts against the shin of the wearer. The attachment member 86 is closed by attaching the opposed ends 92*a* and 92*b* of the Velcro® straps. The device 10 is retained on the lower leg 14 of the user, with the base member 24 in the front, and the seat member 22 is behind the leg, as illustrated in FIG. 2.

Since the device 10 is compact and relatively lightweight, the user can walk with the device 10 conveniently attached to the lower leg 14. When the user wants to kneel, an optional kneepad 100 (FIG. 3) may be attached to the knee onto which the user plans to kneel. Referring to FIG. 3, when the user wants to kneel, the device 10 is pivoted to an unfolded position while it is still attached to the leg 14. For the device to assume the unfolded position, the user pivots the seat members 22*a*, 22*b* and the base member 24 away from the U-shaped body. The seat members 22*a*, 22*b* are pivoted upward and the base member 24 downward until the U-shaped body 12, the first pair of legs 38*a* and 38*b*, and the second pair of legs 54*a* and 54*b* are in a generally parallel configuration. At the same time, the user lifts the heel from the ground, while the leg 14 is still in the device 10, and kneels with the foot behind the body so that the toes, which are pointed downwards, rest on the ground. In this position, the underside 57 of the base 56 rests on the ground, the other foot remains forward of the user's body.

In this orientation, the base 56 and the generally oval shaped seats 22*a* and 22*b* are substantially perpendicular to the U-shaped body 12, and the buttocks are supported by seat members 22*a* and 22*b*, so that the user's weight is partially on the kneepad 100 and partially on the seats 22*a* and 22*b*, thus relieving pressure on the knee. When the user wants to move or rise from the kneeling position, he stands up and pivots the seat member 22 and the base member 24 into the body 12 as illustrated by the dashed lines in FIG. 7. The user can then ambulate with the device 10 attached to the leg 14. The device 10 can be used on either leg at the convenience of the user, and is capable of conveniently being changed from one leg to the other as desired to reduce fatigue on a particular leg.

Figure 8:
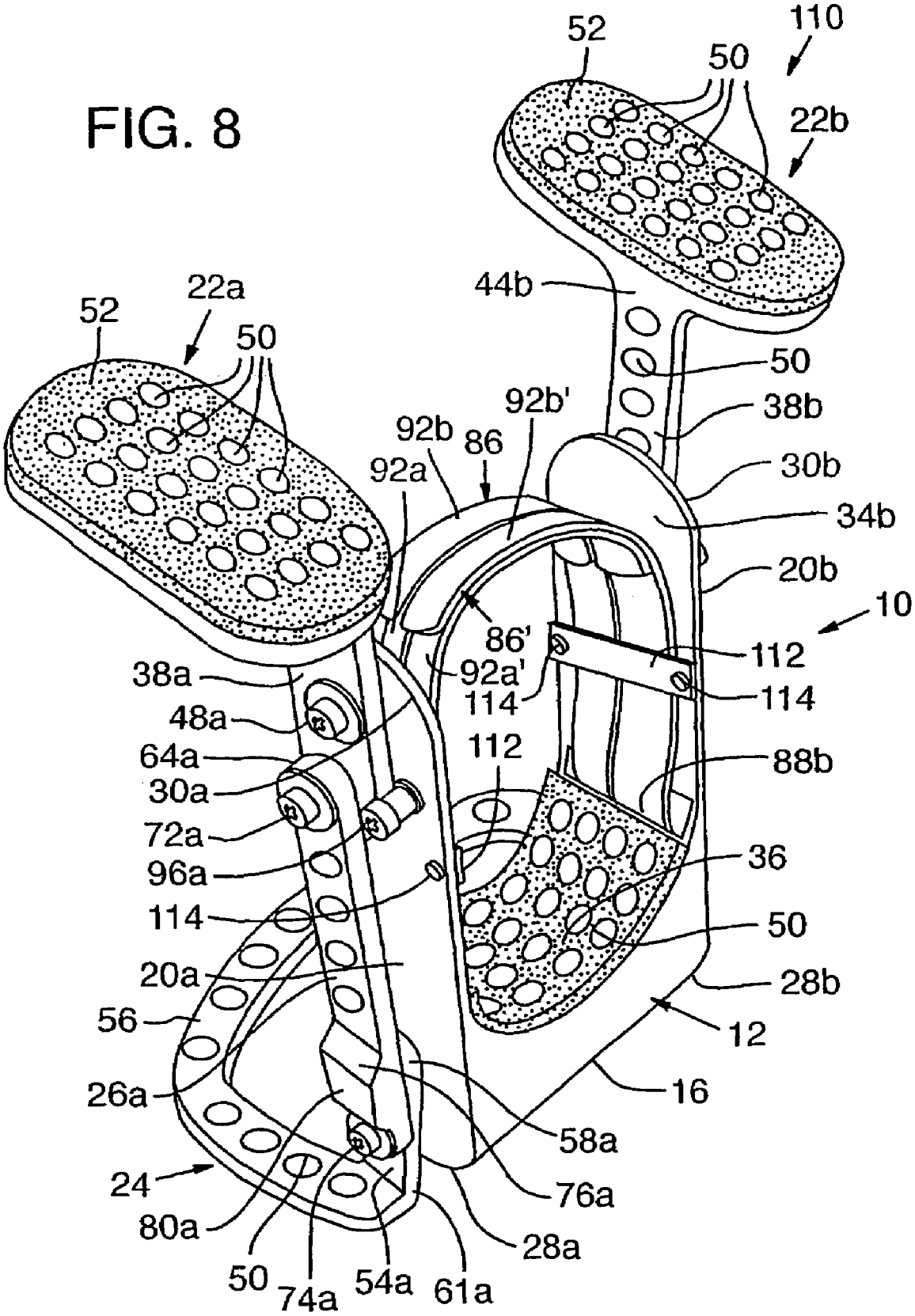
FIG. 8 is a perspective view of another embodiment of a wearable kneel-sit support device shown in the unfolded position.

Referring now to FIG. 8, there is shown a wearable kneel-sit support device 110 according to another embodiment. The components of the embodiment of FIG. 8 that are identical to the corresponding components of the embodiment of FIGS. 1–7 are given the same respective reference numerals and are not described further. As shown in FIG. 8, the device 110 includes first and second attachment members 86 and 86', respectively, rather than one attachment member 86 as in the device 10 of FIGS. 1–7. Each attachment member 86, 86' includes respective first and second end portions 92*a*, 92*b* and 92*a'*, 92*b'*, respectively. The first end portions 92*a*, 92*a'* are configured to be attachable to the corresponding second end portions 92*b*, 92*b'* (e.g., using Velcro®) for securing the leg of a user inside the device 110.

The attachment members 86, 86' in the illustrated configuration are coupled to each of the first and second side members 20*a*, 20*b*, respectively, using respective brackets 112. The brackets 112 can be secured to the first and second side members 20*a*, 20*b* in a conventional manner, such as with the illustrated screws 114. Although not shown in the drawings, the brackets 112 also can be implemented in the embodiment of FIGS. 1–7 for coupling the attachment member 86 to the first and second side members 20*a*, 20*b* of the device 10.

Although the present disclosure has been described in considerable detail with reference to the drawings herein, other embodiments are possible. For example, the body 12, in the illustrated example is U-shaped, but other shapes can also be employed. Although the seats 22*a* and 22*b* are shown as being oval, they can have other shapes, such as round, square, rectangular or other configurations. A single seat can also be used, for example a single support spanning both buttocks or a single seat member that supports only one of the buttocks. In the illustrated example, holes 50 are made in the device 10 in order to lighten it, but the device can be made without the holes. The securing members in the illustrated example are shown as being shoulder bolts, but other securing members can be use such as pins and other fasteners.

The base 56 is shown in FIG. 1 as being substantially horseshoe shaped, but other shapes can also be used. Instead of padding, the seat member 22, the base member 24, and the body 12 can for example be coated with a soft plastic. As would be appreciated by one of ordinary skill in the art, other materials besides aluminum and reinforced plastic can be used to make the device 10. Also, other attachment members 86 can be used, such as buckles or snaps. Therefore, the spirit and scope of the appended claims should not be limited to the descriptions of the embodiments contained herein.

We claim:

1. A wearable knee support device for relieving pressure from a user's knee, the device comprising:

a body adapted to receive the leg of a user;

a seat member connected to the body and adapted to support at least one buttock of the user;

a base member connected to the body and adapted to support the device, the base and the seat member being on opposite sides of the user's leg when the device is being worn on the leg; and at least one linking member connecting the seat member and the base member and whereby moving one of the seat member and the base member causes the seat member and the base member to rotate relative to each other and the body from a folded position adjacent the leg of the user to an unfolded position, wherein the base member can rest on a horizontal surface and the seat member can support the user's weight.

2. The device of claim 1 further comprising a stop attached to the body adjacent the seat member, the stop being configured to prevent pivoting of the seat member and the base member past the unfolded position.

3. The device of claim 1, wherein when the seat member and the base member are in the folded position while the device is being worn by the user, the seat member and the base member reside above the body of the device, and when the seat member and the base member are in the unfolded position while the device is being worn by the user, the base member resides below the body and directly underneath the seat member.

4. The device of claim 1, wherein the body comprises sides aligned in a parallel configuration, a closed end extending between the sides, and an open end disposed opposite the closed end, the open end adapted to receive the leg of the user.

5. The device of claim 4, wherein the sides of the body and the closed end of the body define an inside surface, and an attachment member extends from the inside surface, the attachment member being capable of attaching the lower leg of the user to the body.

6. The device of claim 4, wherein the body has an inside surface and the seat member and the inside surface of the body are padded to protect the user's lower leg.

7. The device of claim 4, wherein the base member comprises a base attached to a pair of legs, the pair of legs attached, respectively, to each of the sides of the body.

8. A method of protecting a knee while kneeling on a surface, comprising:

securing the device of claim 1 to a leg of a subject;

kneeling with the base member on the surface, and the seat member in the unfolded position; and resting the body against the seat member.

9. The method of claim 8, further comprising placing a knee pad on a knee of the subject.

10. The method of claim 8, further comprising rising from a kneeling position, and pivoting the seat member and the base member toward one another to hold the device compactly against the leg while the subject walks.

11. The method of claim 8, wherein the device is secured to the lower leg.

12. A method of protecting a knee while kneeling on a surface, comprising:

securing the device of claim 1 to a leg of a subject;

unfolding the device; and kneeling with the base member on the surface and the seat member supporting at least one buttock of the subject.

13. A wearable knee support device for relieving pressure from a user's knee, the device comprising:

a body having sides aligned in a substantially parallel configuration, the body comprising a closed end extending between the sides, and an open end disposed opposite the closed end, the body being adapted to receive the lower leg of a user;

a seat member pivotally attached to the sides of the body adjacent the open end, the seat member being capable of supporting the user's weight;

a base member pivotally attached to the sides of the body adjacent the closed end, the base member providing support for the device when the user's weight is placed on the seat member; and at least one linking member pivotally connected to the seat member and the base member, whereby pivoting of one of the seat member and the base member causes the linking member to move the seat member and the base member so that the device changes from a folded position wherein the seat member and the base member are folded inwardly towards the body, the device being adapted to the attached to the user's leg while the user is standing, to an unfolded position wherein the base member is adapted to rest on a surface and the seat member is configured to receive the user's weight.

14. The device of claim 13, wherein the seat member comprises a first seat and a second seat supported, respectively, by a pair of legs, the pair of legs being attached, respectively, to the sides of the body adjacent to the open end.

15. The device of claim 13, wherein the base member comprises a base attached to a pair of legs, the pair of legs being attached, respectively, to the sides of the body adjacent the closed end.

16. The device of claim 13, further comprising a stop attached to the body adjacent the seat member, the stop being configured to prevent pivoting of the seat member and the base member past the unfolded position.

17. A wearable knee support device for relieving pressure from a user's knee, the device comprising:

a generally U-shaped body having sides aligned in a substantially parallel configuration, the body comprising a closed end extending between the sides, and an open end located opposite the closed end and adapted to receive the lower leg of a user;

a first pair of legs pivotally attached, respectively, intermediate their proximal and distal ends to the sides of the body adjacent the open end thereof;

a seat supported by the distal ends of the first pair of legs, the seat being capable of supporting the user's weight;

a second pair of legs pivotally attached, respectively, at their proximal ends to the sides of the body adjacent the closed end thereof;

a base attached to the distal ends of the second pair of legs, the base providing support for the body when the user's weight is placed on the seat; and a pair of linking members pivotally connected to the proximal ends of the first pair of legs and intermediate the proximal and distal ends of the second pair of legs, respectively, whereby pivoting of one of the seat and the base causes the linking members to rotate the seat and the base from a first folded position wherein the first and the second pairs of legs are folded inwards toward the body to a second unfolded position wherein the first pair of legs, the second pair of legs, and the body are aligned in a generally parallel relationship, the seat and the base being generally perpendicular to the body, the base being adapted to rest on a surface and the seat being adapted to receive the user's weight.

18. The device of claim 17, further comprising a pair of stops attached, respectively, to each of the sides of the body and adapted to engage the linking members, the stops limiting the rotating of the seat and the base to achieve the second unfolded position.

19. A wearable knee support device for relieving pressure from a user's knee, the device comprising:

a body adapted to receive the leg of a user;

a seat member connected to the body and adapted to receive the weight of a user;

a base member connected to the body and adapted to support the device; and at least one linking member connecting the seat member and the base member and whereby moving one of the seat member and the base member causes the seat member and the base member to rotate from a folded position adjacent the leg of the user to an unfolded position, wherein the base member can rest on a horizontal surface and the seat member can support the user's weight;

wherein the seat member comprises a first seat and a second seat supported by a pair of legs, respectively, the pair of legs attached, respectively, to each of the sides of the body.

20. A wearable knee support device for relieving pressure from a user's knee, the device being changeable from a folded position, wherein the device is attached to the lower leg of the user, to an unfolded position wherein the device is adaptable to rest on a surface and support the weight of the user, the device comprising:

a body having an opening adapted to receive the leg of a user;

a seat member pivotally attached to the body adjacent one end, the seat member being adapted to support weight of the user when the device is in the unfolded position; and a base member pivotally attached to the body adjacent the other end, the base member being adapted to support the device when the device is in the unfolded position; and a linking member linking the seat member to the base member, whereby movement of one of the seat member and the base member rotates the seat member and the base member from the folded position to the unfolded position.

21. The device of claim 20, wherein the seat member comprises a first seat and a second seat supported by a pair of legs, respectively, the pair of legs being attached to the body adjacent the one end.

22. The device of claim 20, wherein the base member comprises a base attached to a pair of legs, the pair of legs being attached to the body adjacent the other end.

23. The device of claim 20, further comprising an attachment member extending from the body, the attachment member being capable of attaching the lower leg of the user to the body.

24. The device of claim 20, further comprising a stop attached to the body adjacent the seat member, the stop being configured to prevent pivoting of the seat member and the base member past the unfolded position.

* * * * *